US005794393A

United States Patent [19]

Fearn

[11] Patent Number: 5,794,393

[45] Date of Patent: Aug. 18, 1998

[54] CONCRETE FOUNDATION WALL FORM APPARATUS AND METHOD

[76] Inventor: Richard Neil Fearn, 1817 Ocean Surf Place, South Surrey, British Columbia, Canada, V4P 9P1

[21] Appl. No.: 657,046

[22] Filed: May 29, 1996

[51] Int. Cl.[6] ..... E02D 27/00

[52] U.S. Cl. ..... 52/294; 52/292; 52/742.13; 52/742.14; 52/169.9; 52/169.14

[58] Field of Search ..... 52/292–299, 250, 52/742.13, 742.14, 169.1, 169.9, 169.14

[56] References Cited

U.S. PATENT DOCUMENTS

| | | | |
|---|---|---|---|
| 3,673,750 | 7/1972 | Bokvist et al. | 52/169 |
| 3,956,859 | 5/1976 | Ingestrom | 52/169 |
| 4,065,893 | 1/1978 | Epes | 52/169 |
| 4,689,926 | 9/1987 | McDonald | 52/169 |
| 4,711,058 | 12/1987 | Patton | 52/101 |
| 4,799,348 | 1/1989 | Brami et al. | 52/742 |
| 5,224,321 | 7/1993 | Fearn | 52/742 |

FOREIGN PATENT DOCUMENTS

| | | |
|---|---|---|
| 838768 | 6/1976 | Belgium . |
| 2271356 | 12/1975 | France . |
| 2531470 | 2/1984 | France . |
| 2610339 | 8/1988 | France . |
| 2062998 | 7/1972 | Germany . |
| 2345173 | 3/1975 | Germany . |
| 2849300 | 5/1980 | Germany . |
| 57-140429 | 8/1982 | Japan . |
| 949352 | 2/1964 | United Kingdom . |

*Primary Examiner*—Beth A. Aubrey

[57] ABSTRACT

A pre-fabricated building foundation form assembly is installed beneath a building floor which is temporarily supported in its final position. The form assembly comprises a plurality of form stiffeners which are spaced apart along a proposed foundation wall and extend downwardly from the floor, each stiffener having laterally spaced apart inner and outer edges. A flexible sheet form element has laterally spaced apart upper portions connected to the edges of the stiffeners and a lower portion spaced below the stiffeners so as to form an essentially continuous elongated container below the stiffeners and in contact with the site surface. A flowable and settable foundation material essentially fills a space within the container and between the flexible sheet forms and extends essentially continuously upwardly from the site surface to a lower surface of the floor assembly to support the floor assembly thereon when the foundation material has cured. Preferably, the stiffeners restrict lateral movement of upper portions of the flexible sheet form element so that lower portions of the flexible sheet form element have a lateral width greater than space between upper portions of the form element to form foundation footings of suitable width.

29 Claims, 8 Drawing Sheets

CONCRETE FOUNDATION WALL FORM APPARATUS AND METHOD

BACKGROUND OF THE INVENTION

The invention relates to a pre-fabricated concrete foundation form apparatus, and method of installation thereof, particularly for use with pre-fabricated buildings or floor assemblies.

The present inventor's U.S. Pat. No. 5,224,321 issued 6 Jul. 1993 discloses a pre-fabricated building foundation form. The patent discloses a method of temporarily supporting at least one pre-fabricated floor assembly in a final position with respect to a building site, and if more than one floor assembly is used, connecting adjacent assemblies together in final aligned and levelled positions above the site. The patent discloses a foundation form assembly which is secured to the floor assembly to extend downwardly therefrom towards the site surface beneath the floor assembly. The form assembly comprises inner and outer rigid sheet panels serving as upper forms, which have upper portions connected to the floor assembly and lower portions connected to a flexible sheet lower form which rests on the site surface and extends as an elongated container between the inner and outer forms. The form assembly receives a flowable concrete mixture and the flexible sheet form conforms to undulations of the site surface and accommodates variations in height between the form and site surface, thus reducing work required to prepare the site surface. Form ties extend between the inner and outer rigid forms to restrict movement therebetween and to resist forces from the concrete before it sets. When the concrete sets, the temporary supports can be removed and the outer rigid sheet forms can be removed, or can remain in place.

In the present inventor's patent, the rigid sheet panels have lower edges connected to the flexible sheet lower form, and for simplicity the form ties are flexible to permit easy movement of the rigid sheet forms to facilitate installation. While the invention disclosed in the patent provides many advantages over prior art foundation structures, the cost of the rigid sheet forms, the time for installing the forms and connecting the flexible sheet forms and rigid forms together, and removing the outer forms if appropriate, increases the costs of both materials and labour for the patented invention when compared with the invention of the present application.

German patent publication 2062998, in which the applicant is Beton-u. Monierbau AG, discloses a foundation apparatus and method in which a flexible sheet form is located beneath a temporarily supported component, and has upper edges of the sheet form connected to the component to provide a tube-like container to receive flowable concrete, which when set supports the component. The sheet form assumes a shape determined to some extent by optional stiffeners positioned within the form but not connected thereto, or other constraints located externally of the sheet form.

SUMMARY OF THE INVENTION

The present invention reduces the difficulties and disadvantages of the prior art as particularized in the above patent and publication, by providing a pre-fabricated building form assembly which utilizes a flexible sheet form element to extend completely between the temporarily supported floor structure and the site surface, thus eliminating the rigid sheet panel upper forms of the previous patent. Use of the flexible sheet form herein reduces installation costs considerably as form material is considerably cheaper than rigid panel material, and furthermore installation time is reduced considerably. The flexible sheet form is stabilized by a plurality of form stiffeners which restrict movement between portions of the flexible sheet forms.

A pre-fabricated building foundation form assembly according to the invention comprises a plurality of form stiffeners, and a flexible sheet form element. The plurality of form stiffeners are adapted to be spaced along a site of a proposed foundation wall, each stiffener having laterally spaced apart inner and outer edges. The flexible sheet form element has laterally spaced apart upper portions adapted to be connected to the inner and outer edges of the form stiffeners at locations which are longitudinally spaced apart along the flexible sheet form element. The flexible sheet form element has a lower portion adapted to be spaced below the plurality of form stiffeners to extend as an essentially continuous elongated container below the plurality of stiffeners.

Preferably, the lower portion of the flexible sheet form element has sufficient size to enable the container to rest upon a site surface located beneath the ties so that width of the container as measured laterally to the foundation wall is greater than spacing between the inner and outer columns of the form assembly. The form stiffener has sufficient stiffness to be self-supporting when disposed in an operative position, to form an essentially plane, open-lattice framework.

A building foundation wall according to the invention is for supporting a generally horizontal floor assembly and comprises a plurality of form stiffeners spaced apart along the foundation wall, and a flexible sheet form element. Each form stiffener has laterally spaced apart inner and outer edges and upper and lower end portions, the upper end portions of the stiffeners cooperating with the floor assembly so that the stiffeners extend downwardly from the floor assembly. The flexible sheet form element has laterally spaced apart upper portions connected to the inner and outer edges of the form stiffeners at locations which are longitudinally spaced apart along the flexible sheet form element. The flexible sheet form element has a lower portion spaced below the plurality of form stiffeners to extend as an essentially continuous elongated container below the plurality of stiffeners. The lower portion of the flexible sheet form element has sufficient size to enable the container to rest upon a site surface beneath the stiffeners. The foundation wall further comprises a mass of flowable and settable foundation material essentially filling space within the container and between the upper portions of the flexible sheet form element and extending essentially continuously upwardly from the site surface to an upper foundation surface which is essentially in contact with a lower surface of the floor assembly to support the floor assembly thereon.

A method according to the invention is for constructing a building foundation wall and comprises the steps of:

- temporarily supporting a floor assembly of a building above a site surface,
- providing a foundation form assembly comprising a flexible sheet form element,
- supporting laterally spaced apart upper portions of the flexible sheet form element below the floor assembly, and supporting a lower portion of the flexible sheet form element on the site surface to extend as an essentially continuous elongated container below the floor assembly, and
- supplying a flowable and settable foundation material to essentially fill spaces within the elongated container and between the upper portions of the flexible sheet form element so that the lower portion of the form element is displaced downwardly to rest upon the site surface so that the foundation material extends essentially continuously upwardly from the site surface to an upper foundation surface thereof which is essentially in contact with a lower surface of the floor assembly so as to support the floor assembly when the material has set.

The method is further characterised by restricting upper portions of the flexible sheet form element from excessive movement from force from the foundation material such that, when the foundation material within the said elongated container rests on the site surface, width of the container as measured generally transversely to the foundation wall is greater than spacing between the upper portions of the flexible sheet form element.

The detailed disclosure following, related to drawings, describes apparatus and method according to the invention, it being understood that the apparatus and method are capable of expression in structure and method other than those particularly described and illustrated.

DESCRIPTION OF THE DRAWINGS

In drawings which illustrate embodiments of the invention.

DETAILED DESCRIPTION

FIGS. 1–5

Figure 1:
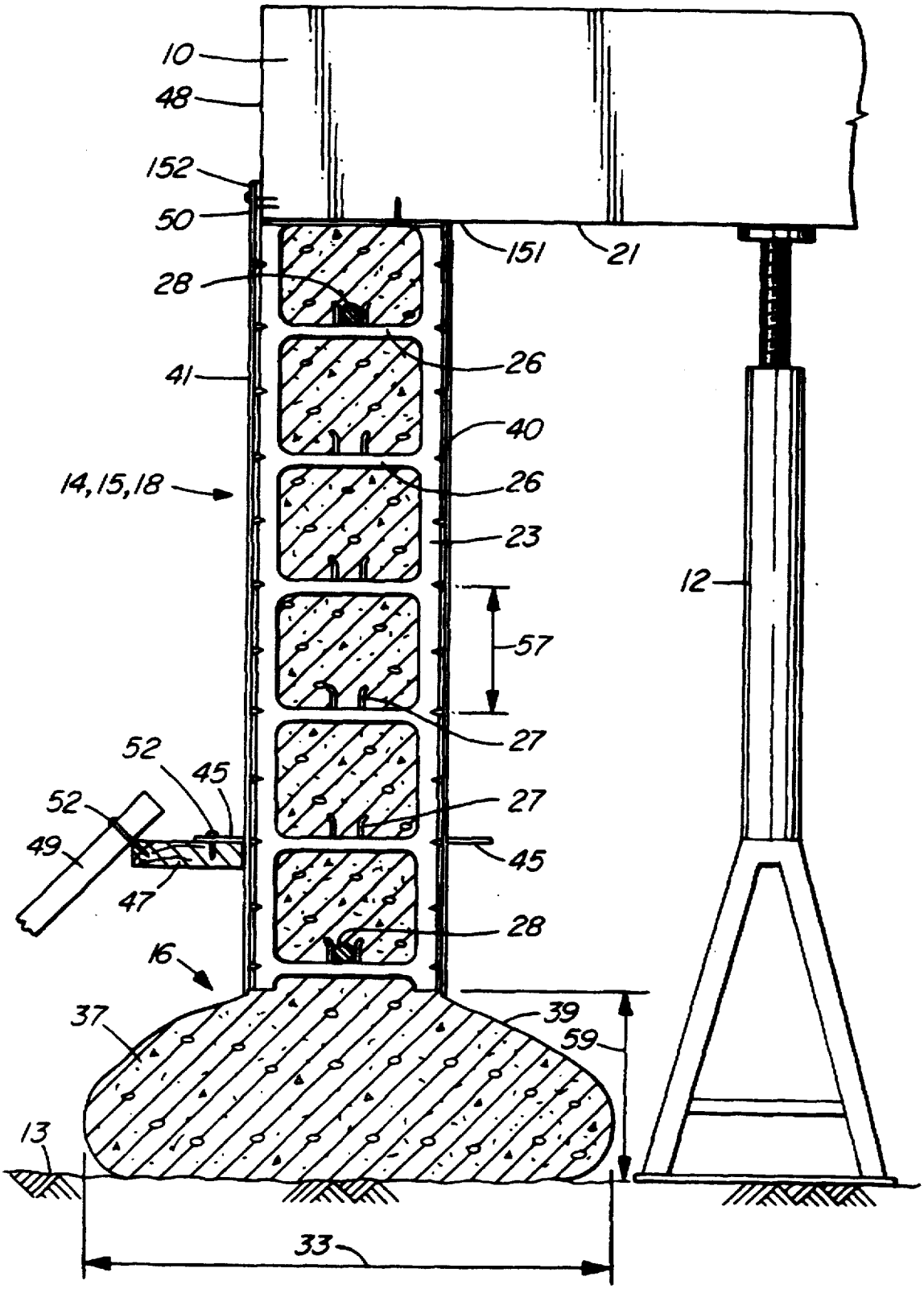
FIG. 1 is a simplified fragmented transverse section through a completed foundation and form stiffener according to the invention after pouring concrete but before removing temporary braces, and is as seen from line 1—1 of FIG. 2.
Figure 2:
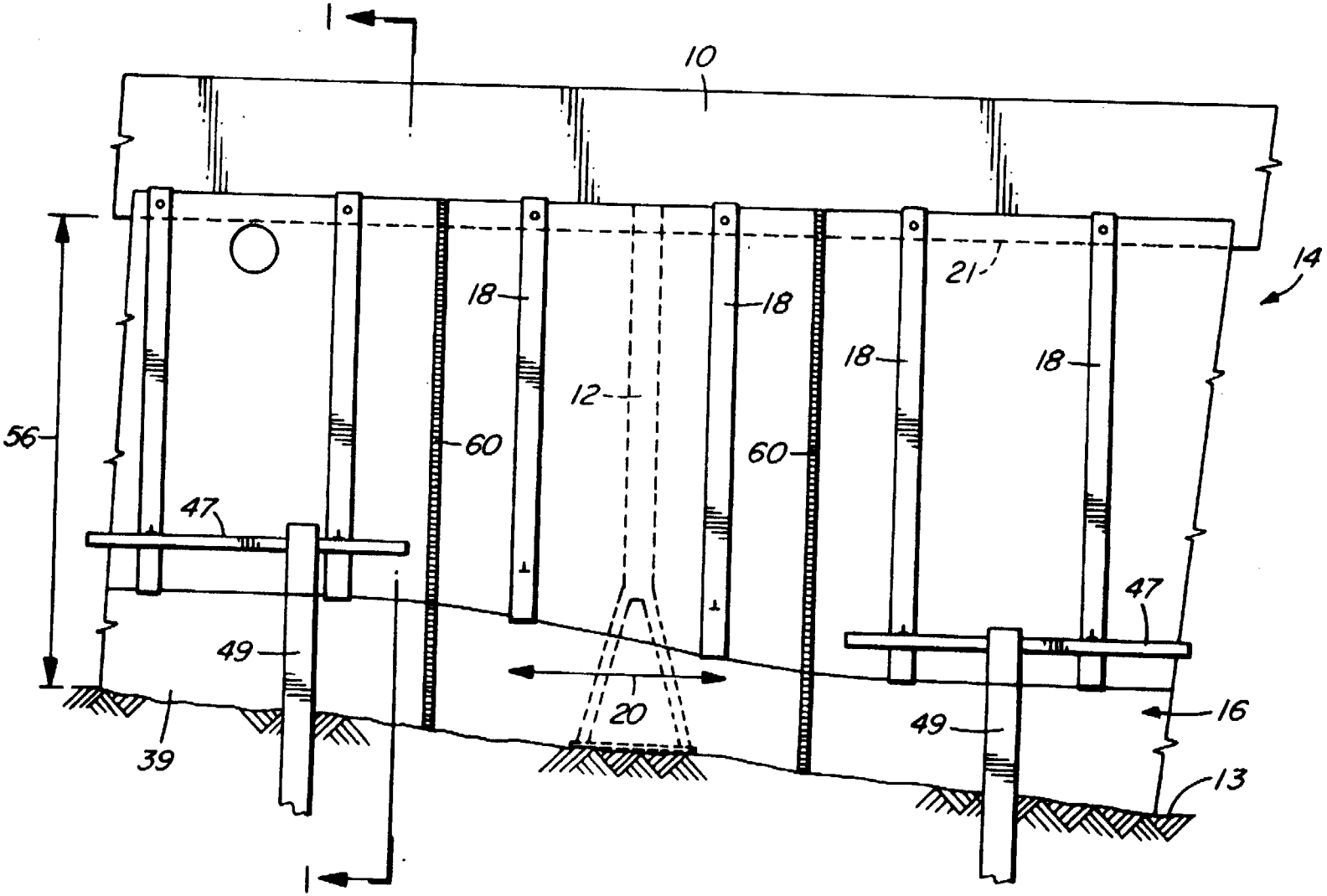
FIG. 2 is a simplified fragmented side elevation of a portion of the completed foundation and form stiffeners according to the invention, shown accommodating a gently sloping building site.

As seen in FIGS. 1 and 2, an outer portion of a prefabricated floor assembly 10 or building floor is shown supported temporarily on one of a plurality of adjustable jacks 12 resting on the ground or site surface 13. A portion of a foundation form assembly 14 according to the invention and a resulting completed foundation wall 15 extend along an outer edge of the floor assembly and, when the concrete is cured, will permanently support the floor assembly 10. Some aspects of the present invention resemble the invention disclosed in the applicant's previously referred to U.S. Pat. No. 5,224,321, the disclosure of which is incorporated herein by reference.

One major difference between the patented invention and the present invention relates to the materials of the foundation form assemblies, which in the patented invention were rigid sheets interconnected by form ties, whereas in the present invention the rigid sheets are eliminated and a flexible sheet form element 16 and generally rigid form stiffeners 18 substituted as follows. The foundation wall 15 is produced from the pre-fabricated building foundation form assembly 14 which comprises the flexible sheet form element 16 and a plurality of the form stiffeners 18 which are adapted to be spaced along a site of the proposed foundation wall at a spacing 20, typically about one foot (30 cms) see FIG. 2.

Figure 3:
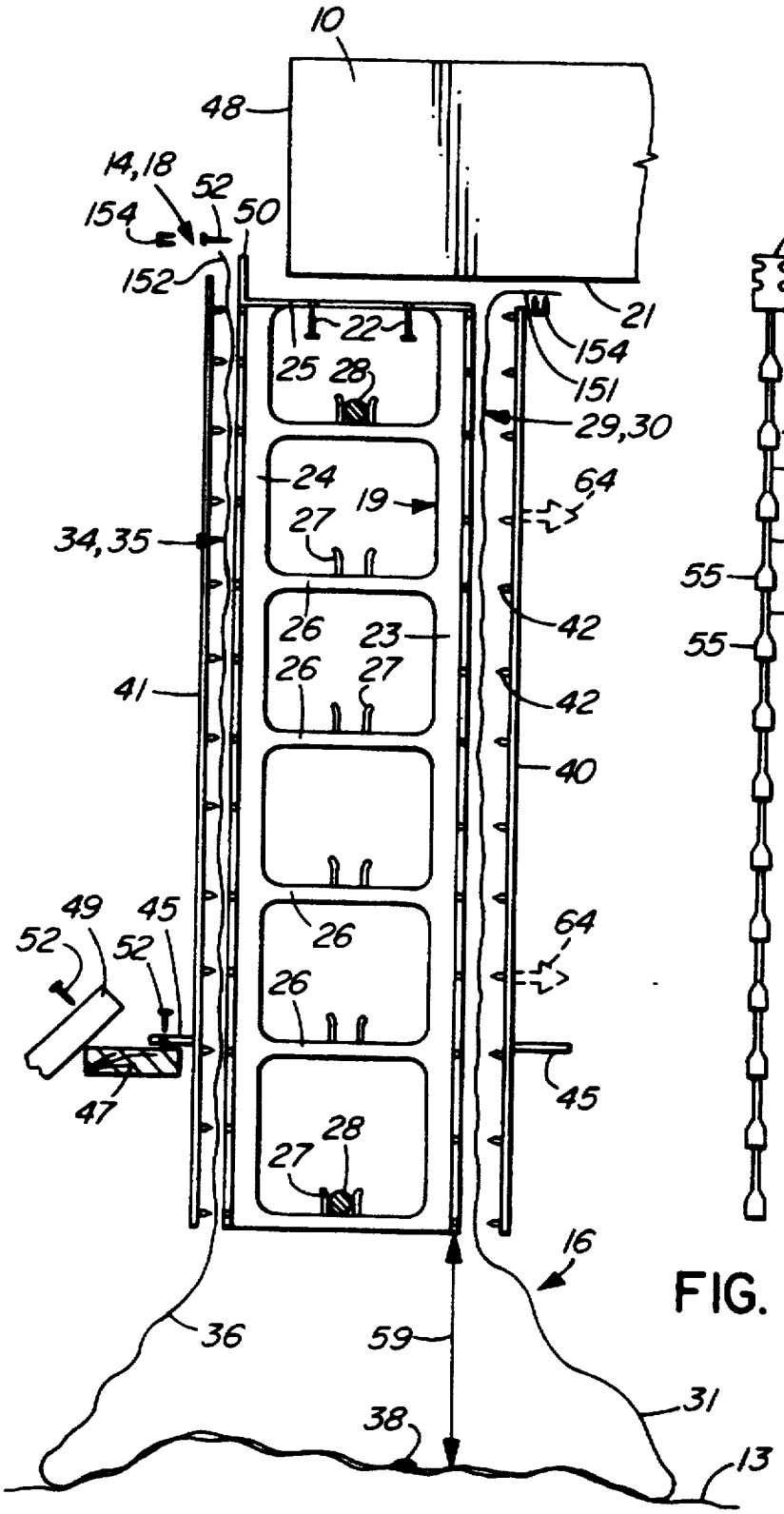
FIG. 3 is a simplified "exploded" and fragmented transverse section through a partially disassembled foundation form before pouring concrete, showing separated portions of the form stiffener, a front elevation of a supporting frame according to the invention, and side elevations of form connectors according to the invention.

Referring specifically to FIG. 3, the form stiffener 10 includes a supporting frame 19 which comprises laterally spaced apart inner and outer columns 23 and 24, and a plurality of column connectors 26 extending between the columns to connect the columns together to form an open lattice frame. The inner and outer columns 23 and 24 define inner and outer edges of the stiffener. Upper ends of the columns or edges are provided with an upper bracket 25 which has sufficient horizontal width to receive fasteners, e.g. screws 22, to pass therethrough to secure the bracket to a lower surface 21 of the floor assembly 10. The inner and outer columns are generally vertical and parallel to each other, and the bracket 25 and the column connectors 26 are generally horizontal and at right angles to the columns so as to form a generally rectangular frame. The inner and outer columns are generally similar elongated straight members which have a complex, varying cross-section to be described with reference to FIGS. 8 through 11. Each stiffener has sufficient stiffness to be self-supporting when disposed in an operative position, that is generally vertically, so as to form an essentially plane open frame in which material of the stiffener is sufficiently stiff to resist forces imposed during assembly and pouring of concrete, and yet causes negligible weakening of the resulting finished foundation wall 15.

Each column connector has a U-shaped bracket 27 extending upwardly at an approximate mid-position of the connector, and is adapted to receive a horizontally disposed reinforcing bar 28 to strengthen the concrete as required. The connector 26 is thus an essentially straight element with sufficient strength to support a reinforcing bar, and the bracket 27 thus serves as a reinforcing member holder to support a foundation reinforcing member. For increased versatility, preferably each column connector has such a holder, but of course which, if any, holder is used in a particular foundation would depend on engineering requirements.

The flexible sheet form element 16 further comprises an inner flexible sheet form 29 which is connected to the inner edges or columns as will be described. The sheet form 29 has an upper portion 30 located adjacent the inner column, and a lower portion 31 spaced below lower end portions of the inner columns. The flexible sheet form element 16 further comprises an outer flexible sheet form 34 similarly connected to the outer edges or outer columns 24, the inner and outer columns being connected to the forms 29 and 34 at locations which are longitudinally spaced apart along the inner and outer flexible sheet forms i.e. along the form element 16, as best seen in FIG. 2. The outer flexible sheet form has an upper portion 35 located adjacent the outer columns, and a lower portion 36 spaced below the lower end portions of the outer columns. The lower portions 31 and 36 of the forms 29 and 34 have approximately equal widths extending below the lower portions of the form stiffeners which are sufficient to provide a footing 37 of adequate width, as shown in FIG. 1 and as will be described later. Edges of the lower portions 31 and 36 of the flexible sheet forms are connected together by a seam 38 which is preferably spaced generally symmetrically from adjacent lower ends of the frame 19. The lower portions of the inner and outer sheet forms are thus contiguous so as to extend as an essentially elongated container 39 below the plurality of stiffeners as seen in FIG. 1. In addition, the lower portion of the sheet forms have sufficient size to enable the container 39 to rest upon the site surface located below the ties so that width 33 of the container as measured laterally to the horizontal wall is typically two or three times greater than spacing between the inner and outer columns of the stiffeners.

Both forms are preferably relatively flexible sheet material, such as a woven polypropylene geotextile fabric material, as manufactured and distributed by AMOCO Corporation, a Corporation of Michigan, U.S.A. However, non-woven flexible membranes such as polymer sheeting can be substituted for the woven polypropylene material. In any event, the flexible sheet form has sufficient flexibility to conform to site surface undulations when the flexible sheet is subjected to forces from poured concrete.

Preferably, for most applications the inner flexible sheet form 29 is permeable to water so as to permit excess water to drain therethrough, whereas the outer flexible sheet form 34 is essentially non-permeable to water to restrict water against draining therethrough. Calculations indicate that hoop stresses in the sheet form can be as high as 12 pounds per lineal inch (210 grams per lineal m.m.), when pouring a foundation wall of approximately 3 feet (0.9 meters) in height, with a footing width 33 of 1.5 feet (0.46 meters). Clearly, as will be described, stresses can be reduced by pouring the foundation wall in several pours, so as to reduce hydrostatic forces generated during a particular pour.

The form stiffener 18 further comprises inner and outer form connectors 40 and 41 which cooperate with the inner and outer columns of the frame 19 and upper portions of the respective inner and outer flexible sheet forms 29 and 34 so as to secure the inner and outer forms to the inner and outer columns respectively. The inner form connector 40 comprises an elongated strip adapted to lie alongside the inner column 23 of the stiffener so as to sandwich the upper portion of the form 29 between the strips and the outer face of the column. The connector 40 includes a plurality of projections 42 extending inwardly from the strip to penetrate the flexible form and to cooperate with a column to be retained thereagainst as will be described with reference to FIGS. 8 through 11. The connector 40 also includes a brace bracket 45 extending outwardly therefrom and is not required for the inner forms, but is provided to simplify tooling, manufacturing, and inventory. The outer form connector 41 is essentially the same as the inner form connector 40, but the outer form connector requires the brace bracket 45 which is used to connect a horizontal longitudinal brace 47 thereto, using nails 52 or other suitable temporary fasteners. As seen in FIG. 2, the brace 47 extends longitudinally between adjacent form connectors along the foundation and maintains the connectors to be generally coplanar with each other to ensure the resulting foundation wall is relatively flat. The brace 47 can be a 2 inch by 4 inch strip of lumber or equivalent material which serves to stiffen the outer portions of the foundation form. Similar obliquely disposed braces 49 are secured with fasteners 52 to the horizontal brace 47 and connected to anchors in the ground, not shown, so as stabilize position of the foundation form assembly against lateral faces from the concrete.

Figure 4:
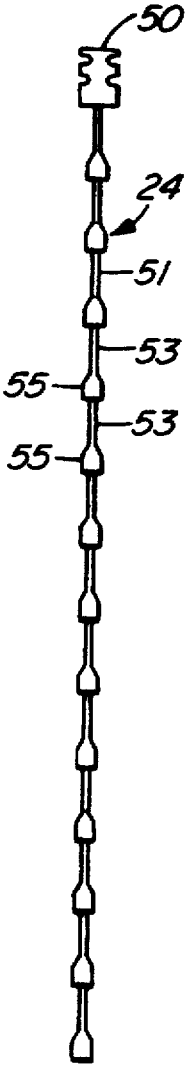
FIG. 4 is a side elevation of the supporting frame of FIG. 3.

Referring to FIGS. 3 and 4, the columns of each stiffener are generally similar to each other, except that the outer column 24 has an extension 50 which extends above the upper bracket 25 a distance sufficient to enable fasteners, e.g. nails or screws 52, to pass through the extension to secure the upper portion to an outer edge face 48 of the floor assembly 10. The remaining portions of the columns are generally similar and thus only the outer column 24 will be described. The column has a web portion 51 extending therealong, and a plurality of clearance portions 53 and latch portions 55 alternating longitudinally along an edge of the web portion to resemble a crenellated flange. The clearance portions 53 initially receive the projections 42 of the fasteners as will be described with reference to FIGS. 8 through 11, which then cooperate with the latch portions 55, so as to retain the strip against the respective column so as to provide a permanent connection between the form and the form stiffener.

Referring to FIGS. 1 and 2, the site surface 13 is shown to be sloping and thus height 56 between the surface 21 of the horizontal floor assembly 10 and the site surface 13 varies. If this height variation between adjacent form stiffeners 18 is significant, that is greater than about 6 inches (150 mm), form stiffeners having different lengths are used. For convenience, the form stiffeners 18 are supplied in different lengths which vary by increments based on vertical spacing or pitch 57 between adjacent column connectors 26. Preferably, the pitch 57 is about 4 inches (100 mm) which is defined as height increment of the form stiffeners. To accommodate variations in the height 56 between the lower surface 21 of the floor assembly and the site surface 13, lengths of the form stiffeners are selected such that space 59 between the lower end of the form stiffener and the site surface 13 is typically between about 4 and 8 inches (100 and 200 mm). Clearly, to maintain sufficient fullness for the lower portions 31 and 36 of the flexible sheet forms, a change in the length of the form stiffener results in the corresponding change in overall width of the flexible sheet form element 16. The change in width of the flexible sheet form element 16 is accommodated by providing separate pieces of flexible sheet forms which have opposite vertical edges of different lengths to accommodate the significant differences in the height 56. The edges of adjacent sheet forms are connected together using zip fasteners 60 which essentially prevent flow of concrete therethrough. Alternatively, the zip fasteners 60 can be eliminated and vertical edges of the sheet forms can be secured using alternative means, such as stapling the edges to a strip of wood or other structure which would essentially eliminate excessive loss of concrete. In this way, the inner and outer flexible sheet forms can extend in an essentially continuous length along a site of moderate slope, so as to permit pouring of the foundation wall in one pour, at least for filling the footing as will be described.

In most situations it is expected that there will be no need to join separate pieces of sheet form to accommodate significant variations in the height 56 between the site surface and the floor assembly. As most site surfaces are prepared by industrial earth moving equipment, site surfaces can be levelled within a few inches of the horizontal, and thus it is anticipated that essentially continuous lengths of flexible sheet form will extend around the building, thus eliminating the need for using different lengths of form stiffeners and different widths of forms on a particular building.

Figure 7:
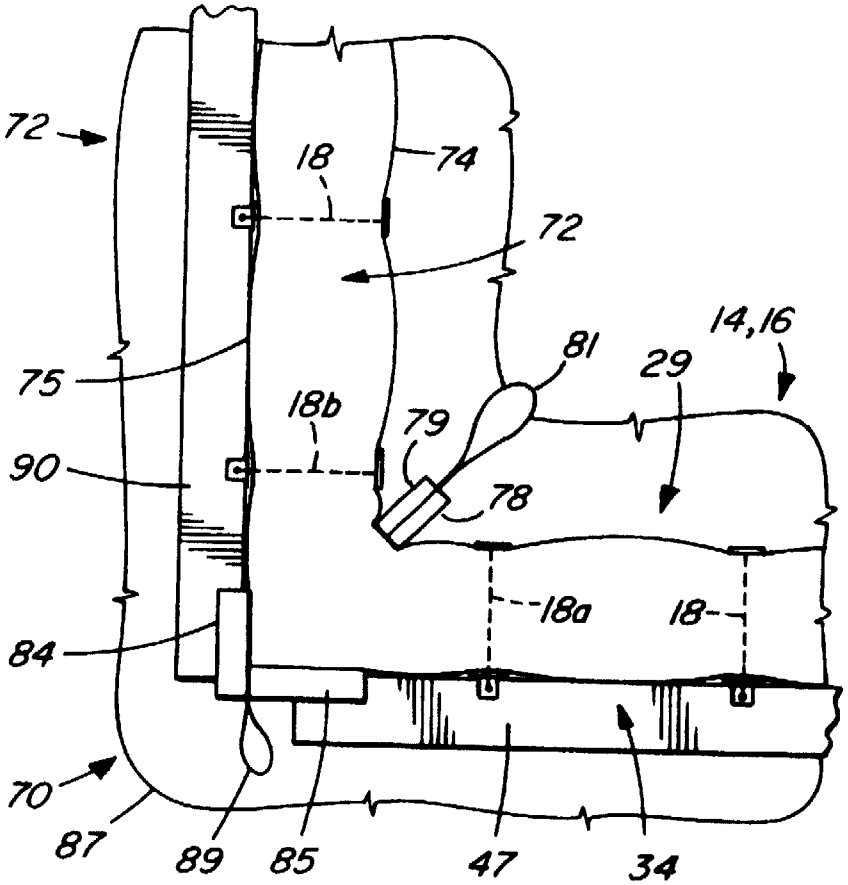
FIG. 7 is a simplified fragmented top plan of the corner of FIG. 6.
Figure 6:
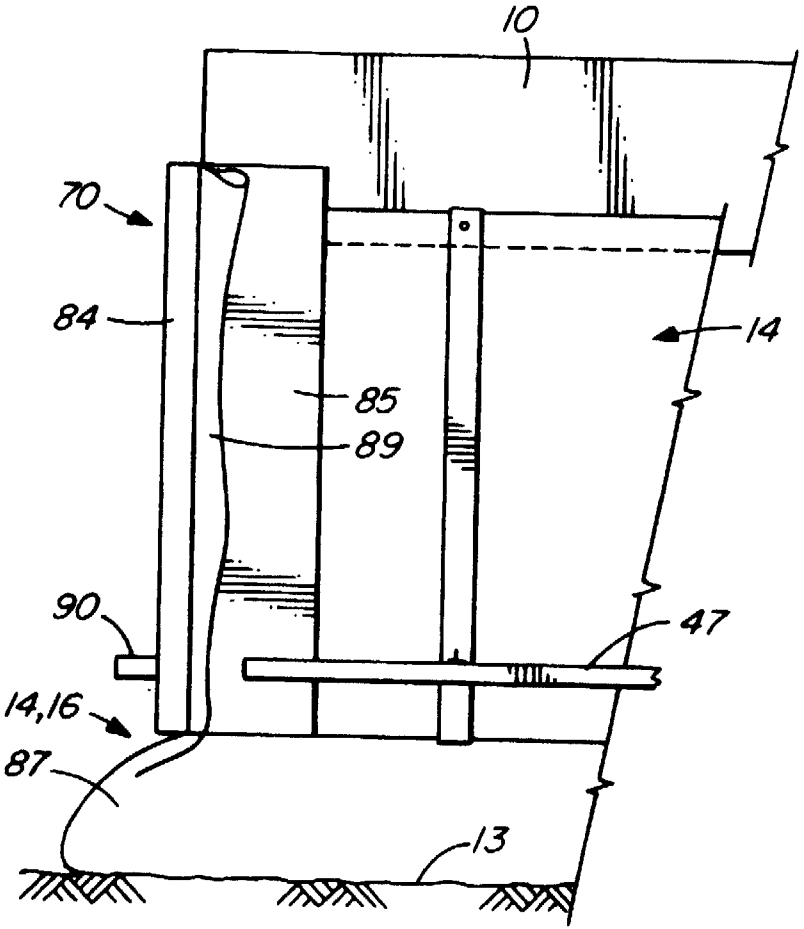
FIG. 6 is a simplified fragmented side elevation of a portion of the foundation and form stiffeners adjacent a corner of the building, before removing temporary braces.

FIGS. 6 and 7

A right angled corner 70 of the foundation requires special consideration for accommodating additional fullness of the forms on the inside of a corner, for providing additional length of in the footing on the outside of the corner, and sealing adjacent edges of each of the walls.

Referring to FIG. 7, the corner 70 is formed by two intersecting foundation form assemblies 14 and 72, the form assembly 72 having inner and outer flexible sheet forms 74 and 75 respectively which are generally similar to the inner and outer flexible sheet forms 29 and 34 of the assembly 14. Specific form stiffeners 18*a* and 18*b* of the foundation form assemblies 14 and 72 respectively are closest to but spaced from the corner sufficiently to provide space for a pair of vertically disposed inner wood strips 78 and 79 to sandwich between adjacent faces thereof portions of the inner flexible sheet forms of both foundation assemblies. Excess portions of the inner flexible sheet forms form a loop 81 of excess sheet so that essentially all sheet form fullness between the form stiffeners 18*a* and 18*b* has been taken up. The wood strips 78 and 79 can be connected together with nails or suitable sized staples to prevent excessive loss of concrete through the inner form. Clearly, the wood strips can either join two separate pieces of the inner flexible sheet form, or can merely take up the slack between a continuously extending inner flexible sheet form which passes around the inside of the corner.

Similarly, outer wood strips 84 and 85 have undesignated adjacent faces which sandwich therebetween upper portions 35 of the outer flexible sheet forms 34 and 75 to produce a similar loop 89 of excess sheet at a vertical corner connection. The brace 47 and an equivalent brace 90 are secured to the wood strips 85 and 84 respectively to provide mutual stability against deflection. Sufficient fullness should be provided in the lower portions of the outer flexible sheet forms to provide a sufficiently generous corner footing 87 which extends outwardly of the corner connection as shown. Clearly, if two separate forms were used, a seam of some form must be provided extending diagonally across the corner, such seam being either zippered as previously described or can be simply be stapling rolled over edges of the form.

FIGS. 8 through 11

The pairs of projections 42, the clearance portions and latch portions 53 and 55 respectively are examples of complementary fastener portions which cooperate with the strip of the connectors and the respective column at the edge of the frame 19 so as to connect the connectors to the stiffeners to sandwich the sheet form therebetween. Because the frame 19 is essentially symmetrical about its centre line, one column only will be described, namely the outer column 24.

Figure 5:
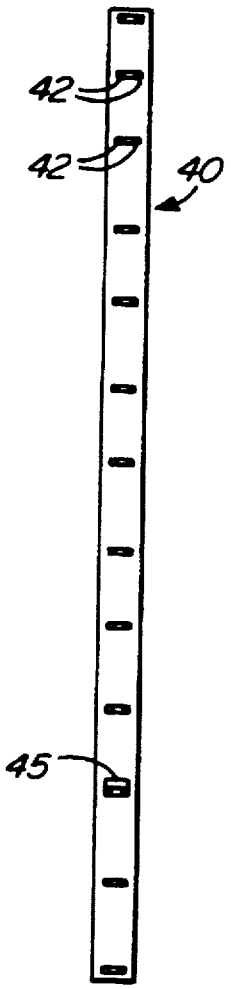
FIG. 5 is a front elevation of the form connector of FIG. 3.
Figure 8:
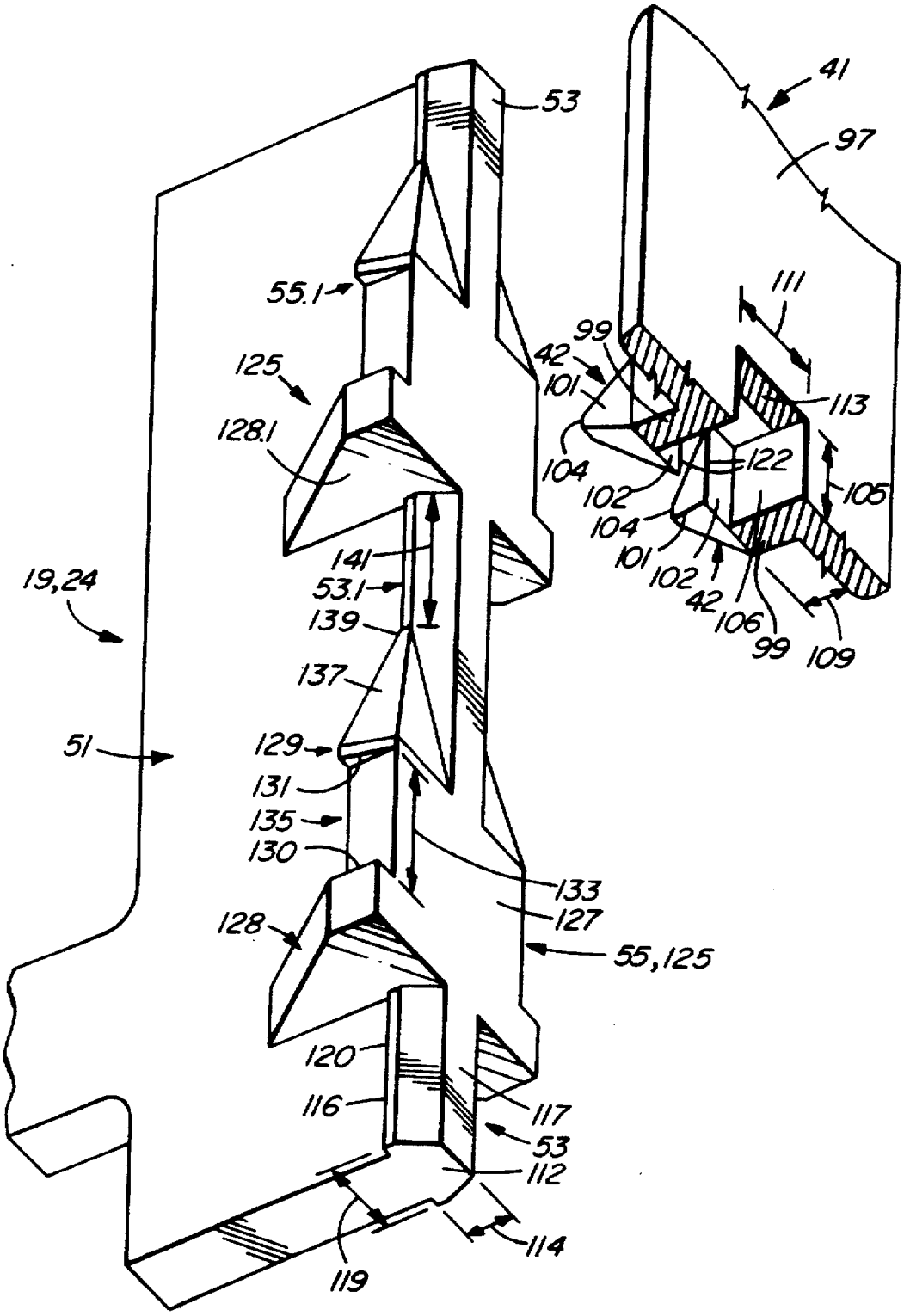
FIG. 8 is a simplified fragmented perspective showing complementary fastener portions of the form stiffener, namely a pair of projections of the connector with adjacent fragments of the connector shown separated from complementary portions of the supporting frame.
Figure 10:
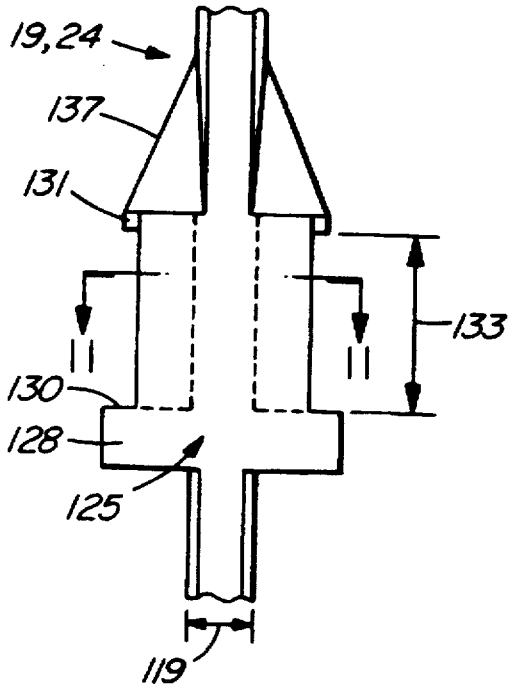
FIG. 10 is a simplified fragmented side elevation of the portion of the frame of FIG. 9, generally similar to but enlarged from that as shown in FIG. 4.
Figure 11:
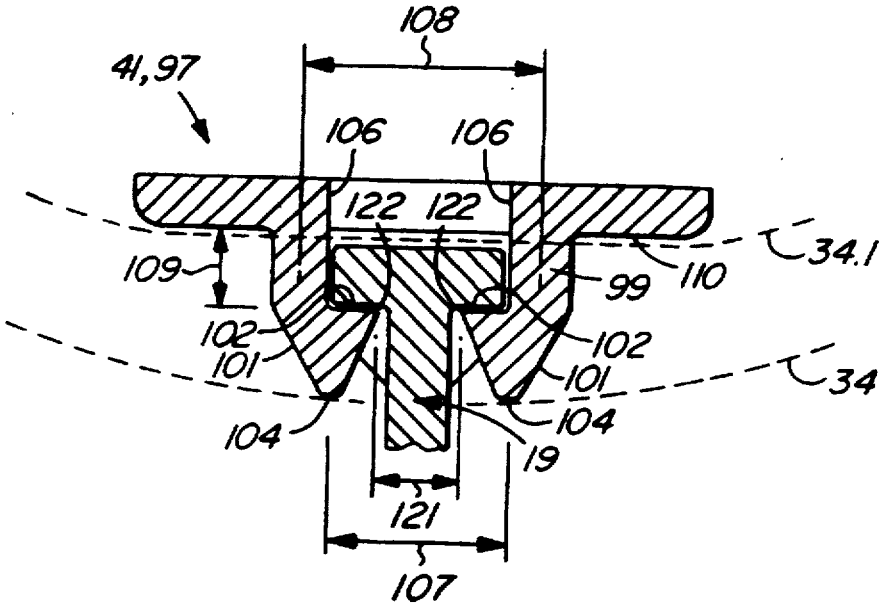
FIG. 11 is a fragmented section of the form stiffener generally as seen from line 11—11 of FIG. 10, showing a portion of the installed frame of FIG. 9 and two approximate locations of the flexible sheet form.

As best seen in FIGS. 8 and 11, the elongated strip of the connector 41 comprises a straight, rectangular-sectioned base portion 97 from which the pair of laterally spaced apart projections 42 extend towards the frame 19. As previously described with references to FIGS. 3 and 5, the strip carries a plurality of pairs of projections 42 which are spaced apart longitudinally and symmetrically along the strip, and as the pairs of projections are essentially similar, one pair only will be described. The projections 42 of each pair are mirror images of each other, and each projection has an inner shank portion 99 adjacent the base portion 97, and an outer end 101 remote from the base portion, the outer end being generally pyramidal in shape with a slightly rounded or radiused apex 104 adapted to penetrate the sheet form. Each projection also has a retaining shoulder 102 which is disposed between the outer end and the shank portion, so that each projection resembles a radiused barbed point of square cross-section.

As best seen in FIG. 11, lateral spacing 107 between the apices 104 generally equals spacing between opposed inner faces 106 of the shank portion 99. Each retaining shoulder 102 extends inwardly towards the remaining projection and thus overhangs the respective inner face 106. The shank portions 99 have undesignated centre lines spaced apart at a spacing 108 which is greater than spacing 107 between the apices 104. The shank portion 99 of each projection has a shank width 109 which defines spacing between the retaining shoulder 102 and an oppositely facing inner face 110 of the base portion. The shank inner face 106 has a shank depth 105, which with the shank width 109 and a shank spacing 111 between the faces 106, are critical for reasons to be described. For manufacturing convenience only, a rectangular opening 113, having a width equal to the spacing 111, is provided in the base portion between the inner faces 106 of the shank portions of the openings, but this serves no other purpose for the invention.

Figure 9:
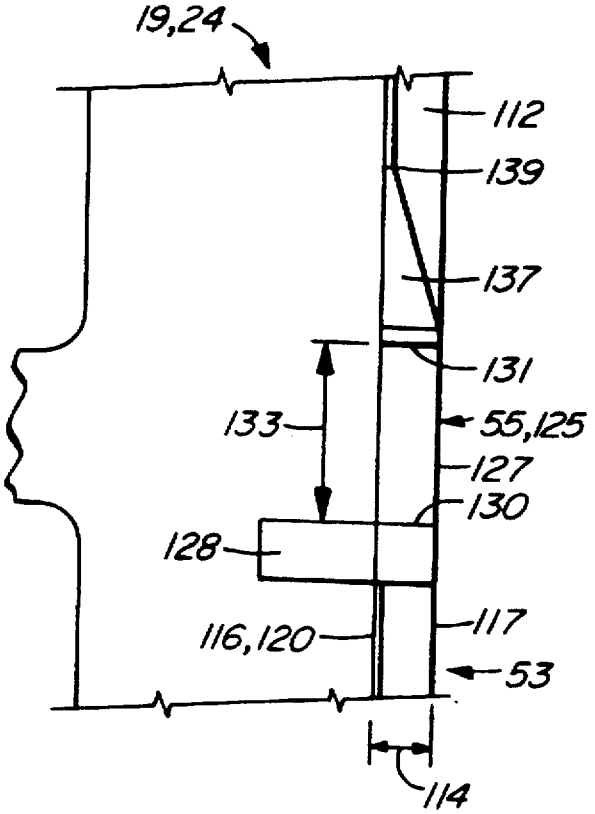
FIG. 9 is a fragmented front elevation of a portion of the supporting frame of the form stiffener, generally similar to but enlarged from that as shown in FIG. 3.

Referring to FIGS. 8, 9 and 11, each clearance portion 53 of the outer column 24 has a generally truncated triangular-sectioned flange 112 extending laterally from the web portion 51. The flange has a flange depth 114 as measured parallel to the web portion to define space between inner and outer faces 116 and 117 of the flange. The flange has a flange width 119 as measured perpendicularly to the web portion at the widest portion thereof, i.e. adjacent an inner step 120 of the flange. The flange depth 114 is approximately equal to or somewhat less than the shank width 109 between the retaining shoulder 102 and the base portion 97 of the projection. The flange width 119 is slightly wider than spacing 121 between oppositely facing inner edges 122 of the shoulder 102 of the laterally spaced pair of projections.

The latch portions 55 of the column 24 are generally similar and symmetrical about a vertical plane and, as best seen FIG. 8, include a latch boss 125 which has an outer face 127 which is generally coplanar with the outer face 117 of the flange 112. The latch boss 125 further includes lower and upper stops 128 and 129 on each side thereof which have oppositely facing lower and upper latch shoulders 130 and 131 respectively. The latch shoulders are spaced apart by a latch spacing 133 which defines a latch recess 135 on each side of the boss having a size to receive one of the projections 42 of the connector. Thus, the spacing 133 is equal to or slightly greater than the shank depth 105 of the projections.

The lower shoulder 130 is relatively large and prevents movement of the projection downwardly with respect to the stop 128 due to load of concrete in the container 39 pulling the connector 41 downwardly, as will be described. In contrast, the shoulder 131 is relatively small as it merely positions the connector over the shoulder 130. The upper stop 129 has an inclined cam face 137 which merges smoothly with the widest portion of the flange 112 at an intersection point 139, and cooperates with the inner face 106 of the shank during assembly as will be described. The point 139 is spaced from an adjacent lower stop 128.1 of a latch portion 55.1 which is spaced above the point 139 by a spacing 141 which defines a clearance portion 53.1 and is at least equal to but preferably about five times greater than the shank depth 105.

The connectors 40 and 41 are connected to the form element 16 preferably off-site, and at that time the supporting frame 19 is not retained between the inner faces 106 of the pair of projections 42 as is shown in FIG. 11. Thus, for the following description of FIG. 11, the latch portion 55 and remaining portions of the frame 19 should be ignored, because this figure discloses the final foundation form as fully interconnected. To retain the connectors on the forms, the outer flexible sheet form is initially penetrated by the projections 42. This penetration occurs essentially simultaneously for at least both projections of each pair of projections of the connector as follows. The apices 104 are located in the required location on the sheet form 34, which is shown in an initial generally taut position in broken outline, and force is applied between the apices and the sheet form so that the apices penetrate the sheet form. As the apices penetrate the sheet, the sheet tears or yields to produce openings therein which permit the sheet to move across the inclined pyramidal faces of the outer ends 101. Eventually the sheet form 34 moves past the shoulders 102 and the parallel shank portions 99 until the sheet form engages the inner face 110 of the base portion 97 and attains a final position 34.1, shown in broken outline. Because the outer ends 101 are generally symmetrical and the sheet form is restrained against excessive lateral movement, there is essentially no relative lateral movement between the connector 41 and the sheet form 34 as the form attains the final position 34.1 thereof. The final attachment of the connector and the sheet forms to the frames 19 to produce the final foundation form assembly as seen in FIG. 11 will be described with reference to the "Operation" as below.

FIG. 12

As described above, the connectors 40 and 41 are preferably initially connected to the sheet form element 16 to produce a form sub-assembly 145 prior to final installation on site as will be described. The form sub-assembly 145 includes the inner and outer flexible sheet forms 29 and 34 which have inner edges connected together by the seam 38 adjacent an intermediate portion 146 of the form element 16. The intermediate portion 146 constitutes the lower portions 31 and 36 when the form element is installed. The forms 29 and 34 have respective outer edges 147 and 148 spaced apart by overall width 150 of the sub assembly, which is sufficiently wide to provide the footing 37 of adequate width as shown in FIG. 1. The plurality of inner form connectors 40 and outer form connectors 41 are connected in aligned arrays extending along the upper (or outer) portions 30 and 35 and generally adjacent the outer edges 147 and 148 respectively by penetrating the as shown in FIG. 11. The connectors 40 and 41 have outer (or upper ends) located slightly inwardly of the edges 147 and 148 respectively to provide respective margin portions 151 and 152 extending along the edges 147 and 148 and being free of any portions of the connectors for reasons to be described. The connectors 40 and 41 have inner (or lower) ends located adjacent the intermediate portion 146 which is thus free of the form connectors to permit the intermediate portion, to deform easily to assume the shape of the container 39 when installed, as shown in FIGS. 1 and 3.

The form connectors 40 and 41 can be connected to the sheet form relatively simply by a machine to ensure even spacing and accurate transverse alignment of each related pair of inner and outer form connectors. Each pair of form connectors is aligned accurately, preferably within about 1/16 inches (1.5 millimeters) to reduce the chances of misalignment, which might otherwise cause excessive strain or distortion of the form or the frames secured to the floor assembly.

OPERATION

The site does not require extensive work prior to building, provided major obstructions are removed and any deep holes are filled, so as to produce a generally flat or slightly sloping surface preferably with maximum deviations from a plane of about 4 inches (100 mm) from a level plane. Similarly to the present applicant's previous patent, there is no requirement for specific treatment or accurate trenching of the ground underneath the foundations provided most organic matter has been removed. To reduce slope of the foundation wall on a more steeply sloping site surface, trenches can be cut using a backhoe, and the trenches would be sufficiently wide to receive the footing 37 but no conventional form work is required.

One or more floor assemblies are temporarily supported on the adjustable jacks 12 (FIG. 1) and are levelled using conventional techniques to set the floor assemblies in their final positions. If more than one floor assembly is to be used, adjacent floor assemblies are connected together following a procedure described in the applicant's previous patent. When all the floor assemblies are suitably levelled and interconnected, the foundation form assembly 14 can be installed as follows.

Figure 12:
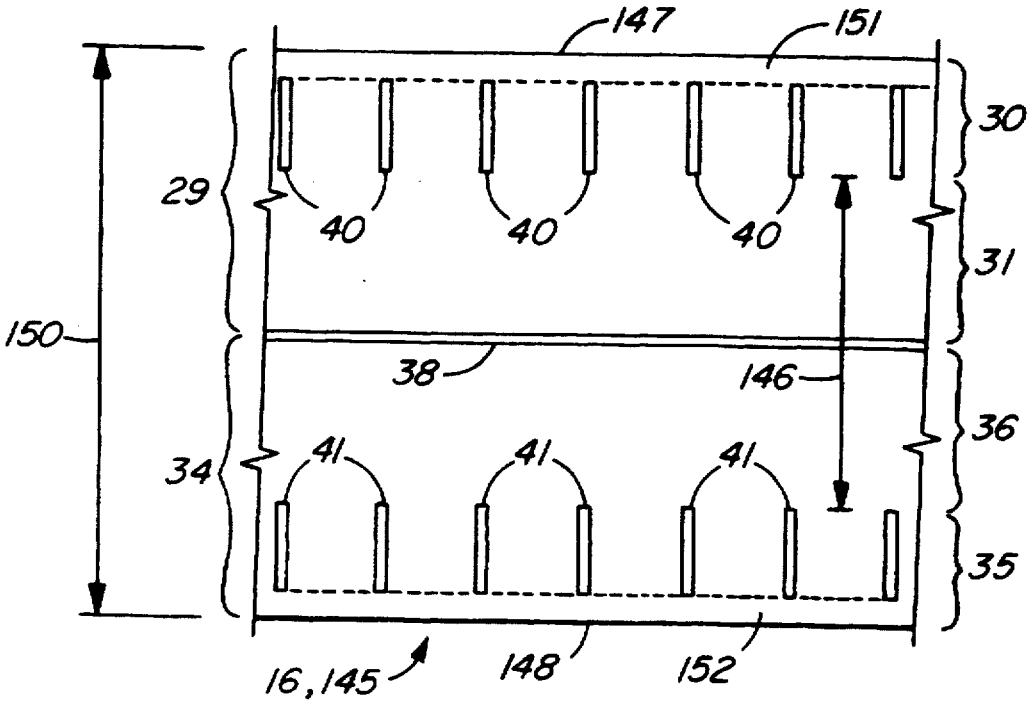
FIG. 12 is a simplified fragmented top plan of a length of flexible sheet form with connectors connected thereto and shown laid on a flat surface prior to an intermediate stage of installation.
Figure 13:
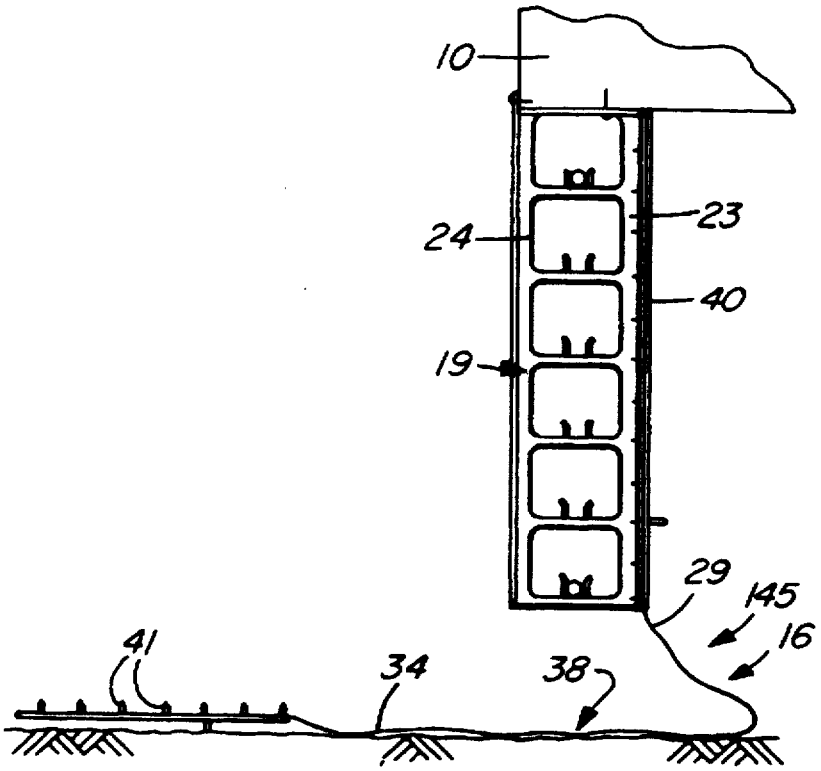
FIG. 13 is a simplified fragmented transverse section through a portion of the pre-fabricated floor assembly and foundation form assembly according to the invention, in the intermediate stage of installation prior to final installation of the outer flexible sheet form and associated connectors.

Referring mainly to FIGS. 3 and 13, a first supporting frame 19 is secured in an initial position underneath the floor assembly 10 using the fasteners 22 passing through the bracket 25 and fasteners 52 passing through the extension 50. The inner form connector 40 adjacent one end of the form sub-assembly 145 (FIG. 12) is positioned so that an uppermost pair of projections on the connector are aligned with uppermost clearance portions 53 of the inner column 23 of the frame 19. The operator can grip the frame with one hand, and while holding and aligning the inner form connector in the opposite hand, applies a horizontal force so that the projections 42 pass through respective clearance portions 53 spaced along the length of the frame 19. It is added that the inner flexible sheet form 29 is carried on the connector in a position which is similar to the form 34.1 on the connection in FIG. 11, and thus does not interfere with the final installation.

As seen in FIG. 8, the manually applied horizontal force moves the retaining shoulders of the projections over the flanges 112 of the clearance portions 53 to attain an initial position in which the inner edges 122 of the shoulders 102 are temporarily positioned in the respective clearance portion 53. The operator then applies a downwards vertical force to the connector which causes the cam faces 137 of the respective upper stops 129 to engage lower edges of the faces 106 of the projections, so that the projections straddle each cam face. As the downwards force is applied further, the projections resiliently move outwardly sufficiently to pass over the lower portions of the cam faces 137 and across the upper shoulder 131 to engage the latch recess 135. Resilience in the material of the connector causes the projections to "snap" back towards each other as the projections pass the upper latch shoulder 131, so as to engage the latch recess 135 when the recess is engaged. In this position, lower faces of the shank portions 99 of the projections rest on the lower shoulders 130, thus locating the connectors in the final position.

This latching of each pair of projections of the connectors engaging each respective clearance opening of the frame occurs simultaneously along the frame 19. Thus each pair of projections passes fully into the respective clearance portion 53 so that, when the connector moves downwardly, each pair of projections is engaged by the respective cam faces to ensure positive retention of each pair of projections in the respective latch recess 135. When this operation has been successfully completed, the second frame 19 can then be connected to the next adjacent inner form connector 40 of the sub-assembly. The second frame 19 is then secured to the floor assembly 10, having first applied sufficient lateral force to the sheet form directed along the edge face 48 to ensure that there is no excessive slack in the sheet form extending between the two adjacent supporting frames 19 when the second frame is secured to the floor assembly.

This process can be continued along the complete length or perimeter of the floor assembly, or until the full length of the inner flexible sheet form 29 of the sub-assembly 145 is connected to the floor assembly, in which case an additional length of form sub-assembly can be secured thereto. The operator can now secure the inner margin portions 151 of the inner flexible sheet form to the lower face 21 of the floor assembly, preferably using relatively closely spaced staples 154, so as to reduce any leakage of concrete between the upper margin of the inner form and the floor assembly. Thus, upper edges of the forms are secured to the floor assembly in addition to securing the upper portions of the forms to the stiffeners. If reinforcing bars 28 are required in the finished foundation, lengths of reinforcing bar 28 can be inserted to pass along the aligned clearances between the connectors 26 of the frames 19, so as to be received in the U-shaped bracket 27 as required. Clearly, for connecting reinforcing bars together, or for any special arrangements for engineering purposes, suitable changes in the procedure disclosed above can be easily incorporated.

When the complete periphery of the foundation has been provided with supporting frames 19 and the inner flexible sheet form 29 has been connected thereto, the operator can draw the remainder of the form sub-assembly 145 from under the frames 19 so that the sub-assembly is in the position as shown in FIG. 13. The operator then connects the outer flexible sheet form 34 to the outer columns 24 of the supporting frames sequentially in a similar manner as previously described for connecting the inner flexible sheet forms to the inner columns. When the outer flexible sheet form has been connected all around the perimeter with the outer connected to 41, the outer margin portions 152 of the outer flexible sheet form are similarly secured by staples 154 to the outer edge face 48 of the floor assembly, in a manner similar to securing the inner margin portions 151.

Referring to FIGS. 6 and 7, the procedure described above can be employed for installing the foundation around a corner of the floor assembly. Continuous lengths of form can pass around the corner, and it is not essential that the form be cut to negotiate a corner. In addition, it is not essential that the form stiffeners 18*a* and 18*b* are equally spaced from the corner, provided there is sufficient clearance between the closest form assembly to permit the pieces of wood strips 78 and 79 to be used to control location of the form adjacent the corner.

When the floor assembly is completely surrounded by a length of foundation floor assembly, or a length sufficient for a concrete pour has been installed, the horizontal braces 47 can be attached to the brackets 45 to connect all the outer form connectors 41 together to ensure that the outer wall of the foundation will be essentially flat. A plurality of the obliquely inclined braces 49 are connected at suitable positions along the braces 47 and have lower ends anchored in the ground to maintain the frames 19 generally vertical.

A flowable concrete mixture can be introduced between the inner and outer flexible sheet forms by cutting an opening in a portion of the outer flexible sheet form generally adjacent the floor assembly and inserting the discharge nozzle from a concrete pump. The concrete passes into the foundation form assembly and fills the lower portions thereof so that the lower portions of the form are displaced outwardly to provide a footing of suitable width as shown in FIG. 1. A suitably sized piece of stiff plastic can be inserted in the opening cut in the form so as to seal the form against excessive leakage of concrete.

The inventor has found that the initial introduction of concrete into the form produces a downwards gravitational force on the form which distributes the form generally evenly about the frames 19, so that the footing is disposed generally symmetrically of the frames. This is the ideal situation which would occur on a generally level site. If the site is sloping laterally with respect to the floor assembly, some corresponding lateral displacement of the footing can be expected, but this is usually of no concern. As the volume of concrete in the foundation assembly increases beyond that in the footing alone, an increasing hydraulic upwards force is applied to the frames which thus reverses the original downwards force applied to the frames. The frames must have sufficient resistance to buckling under this upwards force so that they maintain the desired location of the forms to produce a relatively flat finished wall.

To reduce forces on the foundation form assembly, height of concrete poured in one continuous pour can be limited to approximately three feet (1 m) above the site surface. In this way, the concrete will have an upper surface spaced somewhat below the lower surface 21 of the floor assembly and can be left to at least solidify so as to eliminate buoyancy forces from the concrete. In some applications, to produce a relatively low foundation wall, for example when the floor assembly is less than about two feet (660 mm) above the site surface, the foundation floor assembly can sometimes be filled with one application of concrete, so that an upper surface of the first pour of concrete is immediately adjacent the lower surface 21 of the floor assembly, thus providing direct support when the concrete has cured. In some applications there can be excessive seepage of water through the sheet form, and slow displacement of entrained air in the mixture, and in these cases it is preferable to allow the first pour of concrete to solidify, which also reduces hydraulic forces as described above. To ensure essentially continuous support of the floor assembly along the foundation wall, a second concrete pour to "top up" volume of concrete within the foundation form can be added to the previously solidified concrete so that less air is entrained, and less liquid drains from the second pour when filling. Preferably, to reduce chances of unacceptable voids remaining between the floor under surface 21 and the upper surface of the concrete, for most situations at least the said second pour of concrete is used to fill the last few inches of the form, so that when the final upper surface of the concrete is cured, it is immediately adjacent the lower surface of the floor assembly to provide essentially continuous support along the foundation periphery.

When the concrete has cured, the temporary supports can be removed and weight of the floor assembly is then borne by the foundation wall. The braces 49 and 47 are also removed and any backfilling performed if necessary, which may cover the brace brackets 45. The inner and outer form connectors 40 and 41 remain in place.

It can be seen that the flexible sheet form element is positioned along an axis of the foundation wall and is manually formed into a generally U-shaped cross section, although the term "U-shaped" as used herein and in the claims does not truly reflect the disclosed shape of the cross section and is selected for convenience only. Clearly, in FIG. 1 the cross section is a relatively symmetrical flattened U-shape extending laterally in two directions, and an alternative, as will be described in FIG. 14, the shape is an asymmetrical flattened U-shape extending laterally in one direction. This term "U-shaped" is selected to facilitate designation of the three components of the flexible form when assembled, namely the generally parallel, spaced apart inner and outer upper portions which are connected to the inner and outer edges respectively of the form stiffeners, and the lower portion which is below and contiguous with and interconnects both upper portions. The shape of the lower portion is highly variable and, once filled with the flowable concrete mixture, assumes a shape dependent on the site surface and other factors such as the amount of slackness extending between the upper portions. Clearly the flexible sheet form element is sufficiently flexible to be easily formed manually into the U-shape and to be held against the form stiffeners, whereas each form stiffener has sufficient stiffness to be self-supporting when disposed vertically in the operative position. In addition, the upper portions of the flexible sheet form element extend between longitudinally spaced adjacent form stiffeners with negligible slackness provided within the flexible sheet form element. In contrast the lower portion of the flexible sheet form element extends between the laterally spaced apart upper portions of the flexible sheet form element with sufficient slackness provided within the flexible sheet form element to ensure that the container has a lateral width greater than the width of the form stiffness so as to provide a footing of adequate width for engineering purposes.

It can be seen that the method of the invention comprises the steps of:

temporarily supporting a floor assembly of a building above a site surface, providing a foundation form assembly comprising a flexible sheet form element, supporting laterally spaced apart upper portions of the flexible sheet form element below the floor assembly, supporting a lower portion of the flexible sheet form element on the site surface to extend as an essentially continuous elongated container below the floor assembly, and supplying a flowable and settable foundation material to essentially fill spaces within the elongated container and between the forms so that the lower portions of the forms are displaced downwardly to rest upon the site surface so that the foundation material extends essentially continuously from the site surface to an upper foundation surface thereof which is essentially in contact with a lower surface of the floor assembly so as to support the floor assembly when the material has set.

Preferably, the method is further characterised by restricting upper portions of the flexible sheet form element from excessive movement from force of the foundation mixture such that, when the foundation material within the first elongated material rests on the site surface, width of the container as measured generally transversely to the foundation wall is greater than spacing between the upper portions of the flexible sheet form element.

The method is further characterised by:

connecting a plurality of form stiffeners at spaced intervals along the floor assembly to extend downwardly therefrom, and connecting the upper portions of the inner and outer flexible sheet form element to the form stiffeners to restrict said excessive movement of the flexible sheet form element from force from the foundation material.

ALTERNATIVES

In the preferred embodiment, the flexible sheet form element 16 comprises inner and outer flexible sheet forms 29 and 34 made from two different types of geotextile fabric which are connected by the seam 38 along the centre of the flexible sheet form element. The outer sheet form is essentially non-permeable, while the inner sheet form is permeable. Under some circumstances this is undesirable or not necessary, and the flexible sheet form element 16 can be made of a single piece of fabric, thus eliminating the seam 38.

In some locations having harsh winters, it is common to insulate the "crawl space" between the site surface and the floor assembly by providing insulation on the inner surface of the foundation wall. In the present invention, rigid expanded plastic or foam insulation can be easily and quickly secured to inner (or outer) surface of the foundation wall by providing optional barbs 64 (see FIG. 3) which extend from the inner (or outer) connector 40. Preferably, at least two barbs 64 are provided on each connector, adjacent upper and lower ends of the connector. When the foundation wall is finished, rigid expanded plastic or foam insulation sheets can be secured to the wall by simply pushing the sheet onto the barbs, which easily penetrates the plastic surface and retains the plastic insulation sheets against the wall.

FIG. 14

Figure 14:
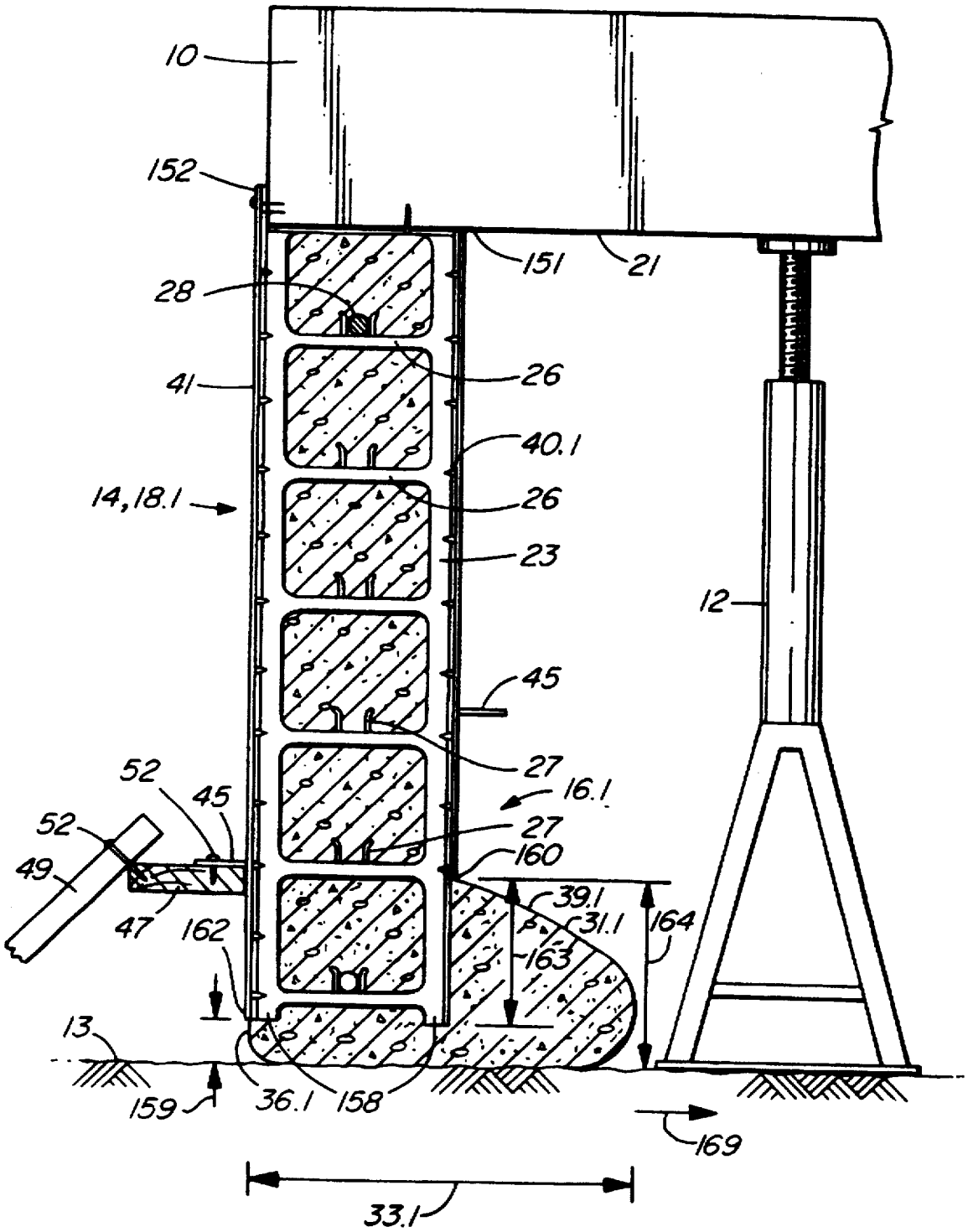
FIG. 14 is a simplified fragmented transverse section through an alternative completed foundation wall according to the invention after pouring concrete, but before removing temporary braces, many portions being generally similar to corresponding portions of the embodiment shown in FIG. 1.

FIG. 14 bears a close resemblance to FIG. 1 and thus components of FIG. 14 that are identical to those of FIG. 1 are identified by identical annotations. Components in FIG. 14 which function equivalently to components in FIG. 1 are identified by the identical numerical reference followed by decimal one, i.e. .1.

In FIG. 1, the inner and outer form connectors 40 and 40.1 have essentially equal lengths and extend for essentially the full length of the form stiffener 18. Lower end portions of the form stiffener 18 and the inner and outer form connectors 40 and 41 are generally adjacent each other and spaced at the spacing 59 above the site surface 13, which spacing is typically between about 4 inches and 8 inches (about 100 and 200 centimeters). In contrast, in FIG. 14 a lower end portion 158 of the form stiffener 18.1 is spaced much closer to the site surface 13, at a spacing 159. An alternative inner form connector 40.1 is shorter than the form stiffener 18.1 and has a lower end portion 160 which is spaced from the lower end 158 of the form stiffener 18.1 by a spacing 163 which, in this instance, is approximately equal to the spacing or pitch 57 of FIG. 1, but this is not necessary. The end portion 160 is spaced above the surface 13 by a spacing 164 which is approximately equal to the spacing 59 of FIG. 1 and is between 4 inches and 8 inches. In contrast, the outer form connector 41 extends the full length of the form stiffener 18.1 and has a lower end portion 162 spaced generally at the spacing 159 above the site surface 13. The spacing 159 is much smaller than the spacing 164, and is typically between about 1 and 3 inches (25 and 75 millimeters) for reasons to be described.

An alternative flexible sheet form element 16.1 extends from undesignated laterally spaced apart upper edges secured to the floor assembly 10, to inner and outer lower portions 31.1 and 36.1 adjacent the inner and outer portions of the form stiffener. The outer lower portion 36.1 is relatively short and is drawn inwardly under the floor assembly per arrow 169 so that there is relatively little bulging between the lower end portion 162 of the fabric connector 41 and the site surface 13. In contrast, the lower form 31.1 bulges inwardly as shown to produce an asymmetrical elongated container 39.1. When filled with concrete, the form element 16.1 provides an asymmetrical footing having a width 33.1 which is sufficiently wide for engineering purposes but does not produce the bulge on the outside of the foundation as found in FIGS. 1 through 3. This produces a foundation which has a generally flat outside surface and is more aesthetically pleasing in situations where most of the footing is above grade and an outwards bulge as found in FIGS. 1 through 3 would detract from the appearance of the footing. The inventor believes that the alternative of FIG. 14 has particular applications to "retrofit" peripherally extending concrete foundations for mobile homes that have already been installed at a site. It is seen that the alternative concrete foundation can be retrofitted to a long established mobile home with minimal disturbance to the surrounding peripheral site surface which may include long established flower beds, trees, etc.

What is claimed is:

1. A prefabricated building foundation form assembly comprising:

(a) a plurality of form stiffeners for spacing longitudinally apart along an axis of a foundation wall to be constructed, each form stiffener having a width defined by laterally spaced apart inner and outer edges of the form stiffener, which edges are also spaced longitudinally apart from corresponding edges of other form stiffeners, each form stiffener to be located to extend generally transversely of the axis of the foundation wall so as to extend across corresponding width of the foundation wall so that the inner and outer edges of the form stiffener are disposed on opposite sides of the axis, and (b) a flexible sheet form element for positioning along the axis of the foundation wall and for forming into a generally U-shaped cross section so that the sheet form element has inner and outer upper portions for connecting to at least upper portions of the inner and outer edges respectively of the plurality of form stiffeners at locations which are longitudinally spaced apart along the flexible sheet form element, the generally U-shaped cross section of the sheet form element also having a lower portion contiguous with the upper portions for locating below the plurality of form stiffeners to extend as a substantially continuous elongated container below the plurality of stiffeners.

2. The assembly as claimed in claim 1, in which:

(a) the lower portion of the flexible sheet form element has sufficient size to enable the elongated container formed from the sheet element to rest upon a site surface located beneath the form stiffeners, the container having a lateral width which is greater than the width of the form stiffeners.

3. The assembly as claimed in claim 1, in which:

(a) the flexible sheet form element is sufficiently flexible to be easily formed manually into the U-shape and held against the form stiffeners, and (b) each form stiffener has sufficient stiffness to be self-supporting when disposed generally vertically in an operative position to form a substantially plane, open lattice framework extending between and supporting the upper portions of the flexible sheet form element.

4. The assembly as claimed in claim 1, in which each form stiffener comprises:

(a) a supporting frame having inner and outer columns which are elongated straight members having outwardly facing surfaces which provide the inner and outer edges respectively of each form stiffener to contact the inner and outer portions respectively of the flexible sheet form element, the supporting frame also having a plurality of column connectors which are substantially straight elements extending between the inner and outer columns to connect the columns together to form an open framework.

5. The assembly as claimed in claim 4, in which:

(a) the inner and outer columns of each frame are generally vertical and parallel to each other, and (b) the column connectors are parallel to each other and generally at right angles to the columns so as to form a generally rectangular open lattice frame.

6. The assembly as claimed in claim 1, in which the flexible sheet form element comprises:

(a) an inner flexible sheet form which is permeable to water so as to permit excess water to drain therethrough, the inner sheet form being connectable to the inner edges of the form stiffeners, and (b) an outer flexible sheet form which is substantially non-permeable to water to restrict water against draining therethrough, the outer sheet form being connectable to the outer edges of the form stiffeners, the inner and outer flexible sheet forms being connected together.

7. The assembly as claimed in claim 1, in which each form stiffener further comprises:

(a) a plurality of form connectors which cooperate with the inner and outer edges of the form stiffener and the flexible sheet form element so as to secure the upper portions of the flexible sheet form element to the inner and outer edges respectively of the form stiffener.

8. The assembly as claimed in claim 7, in which:

(a) each form stiffener includes a supporting frame having interconnected inner and outer columns, the columns having outwardly facing outer faces, and (b) each form connector comprises an elongated strip connectable to one outer face of one column of each form stiffener, and the foundation form assembly further comprises:

(c) a plurality of complementary fastener portions cooperating with each elongated strip and the column so as to sandwich portions of the flexible sheet form element between the form connectors and the outer faces of the columns.

9. The assembly as claimed in claim 8, in which the complementary fastener portions comprise:

(a) each elongated strip of the form connectors having a plurality of projections extending therefrom, the projections being shaped so as to penetrate the flexible sheet form element when forced thereagainst to produce openings in the flexible sheet form element, and to pass through the openings so produced in the flexible sheet form element, and (b) each outer face of each column of each form stiffener having a plurality of clearance portions to receive the projections of the respective elongated strip therein so as to retain the strip against the respective column.

10. The assembly as claimed in claim 8, in which the complementary fastener portions comprise:

(a) each elongated strip of each form connector comprises a base portion and a plurality of pairs of laterally spaced apart projections extending therefrom, each projection having an inner shank portion adjacent the base portion, a tapered outer end to penetrate the flexible sheet form element, a portion of the outer end being larger than the inner shank portion to provide a retaining shoulder located between the outer end and the inner shank portion so that the projection resembles a barbed point, and (b) each column of each stiffener comprises a plurality of clearance portions and latch portions alternating along the column, each latch portion comprising a latch boss having a latch recess on each side thereof, each recess having a size to receive a projection of each pair of projections when engaged by the retaining shoulders thereof, so that when the outer ends of the projections are forced through the flexible sheet form element, downwards movement of the form connector causes the projections and the retaining shoulders thereof to engage the adjacent latch recesses, so that adjacent portions of the flexible sheet form element are retained between the base portion of the strip and the outer face of the respective column, and the projections of each pair are located in the latch recesses to restrict lateral movement of the form connector with respect to the stiffener.

11. The assembly as claimed in claim 10, in which:

(a) each latch portion of the columns has at least one latch recess defined in part by a latch spacing extending between upper and lower latch shoulders of the latch portion, and (b) the shank of at least one projection of each pair of projections has a depth which is less than the latch spacing so that the shank can be received between the latch shoulders to restrict further movement of the connector with respect to the stiffener.

12. The form assembly as claimed in claim 1, in which:

(a) the upper portions of the flexible sheet form element extend between the form stiffeners with negligible slackness provided within the flexible sheet form element, and (b) the lower portion of the flexible sheet form element extends between the laterally spaced apart upper portions of the sheet with sufficient slackness provided within the flexible sheet form element to ensure that the container has a lateral width greater than the width of the form stiffeners.

13. An assembly as claimed in claim 1, further comprising:

(a) each form stiffener has at least one reinforcing member holder to support a foundation reinforcing member.

14. A prefabricated building foundation form assembly comprising:

(a) an elongated flexible sheet form element having longitudinally extending generally parallel outer edges and laterally spaced apart outer portions which are adjacent the respective outer edges, the elongated flexible sheet form element having an intermediate portion extending longitudinally, generally parallel to and disposed between the outer portions of the flexible sheet form element, and (b) a plurality of form connectors connected to the outer portions of the flexible sheet form element in aligned arrays extending along the flexible sheet form element, in which one of the form connectors located on one of the outer-portions on one side of the intermediate portion is transversely aligned with another form connector located on the other outer portion of the flexible sheet form element on the opposite side of the intermediate portion, the form connectors being generally parallel with each other and extending in spaced apart rows lengthwise along the outer portions of the flexible sheet form element, the form connectors having outer ends generally adjacent the outer edges of the form element, and inner ends being located adjacent the intermediate portion so that most of the intermediate portion is clear of the form connectors to permit the intermediate portion to deform easily manually when installing the form assembly.

15. A building foundation wall for supporting a generally horizontal floor assembly, the foundation wall comprising:

(a) a plurality of form stiffeners spaced longitudinally apart along an axis of the foundation wall, each form stiffener having a width defined by laterally spaced apart inner and outer edges of the form stiffener which edges are also spaced longitudinally apart from corresponding edges of other form stiffeners, each form stiffener also having upper and lower end portions, the upper end portions of the stiffeners cooperating with the floor assembly so that the stiffeners extend downwardly from the floor assembly, each form stiffener being located to extend generally transversely of the axis of the foundation wall so as to extend across corresponding width of the foundation wall so that the inner and outer edges of the form stiffener are disposed on opposite sides of the axis, (b) a flexible sheet form element positioned along the axis of the foundation wall and formed into a generally U-shaped cross section so that the sheet form element has laterally spaced apart inner and outer upper portions connectable adjacent to the floor assembly and connected to at least upper portions of the inner and outer edges respectively of the plurality of form stiffeners at locations which are longitudinally spaced apart along the flexible sheet form element, the generally U-shaped cross section of the flexible sheet form element also having a lower portion contiguous with the upper portions and spaced below the plurality of form stiffeners to extend as a substantially continuous elongated container below the plurality of stiffeners, the lower portion of the flexible sheet form element having sufficient size to enable the elongated container to rest upon a site surface beneath the stiffeners, and (c) a mass of flowable and settable foundation material substantially filling space within the elongated container and between the upper portions of the flexible sheet form element and extending substantially continuously upwardly from the site surface to an upper foundation surface which is substantially in contact with the lower surface of the floor assembly to support the floor assembly thereon when the foundation material has set.

16. The foundation wall as claimed in claim 15, in which:

(a) the container has a width measured generally transversely to the foundation wall which is greater than spacing between the inner and outer columns of the form stiffeners.

17. The foundation wall as claimed in claim 15, in which each form stiffener comprises:

(a) a supporting frame having inner and outer columns which are elongated straight members having outwardly facing surfaces which provide the inner and outer edges respectively of each form stiffener, and a plurality of column connectors which are substantially straight elements extending between the inner and outer columns to connect the columns together to form an open framework.

18. The foundation wall as claimed in claim 15, in which the flexible sheet form element comprises:

(a) an inner flexible sheet form which is permeable to water so as to permit excess water to drain therethrough, the inner sheet form being connectable to the inner edges of the form stiffeners, and (b) an outer flexible sheet form which is substantially non-permeable to water to restrict water against draining therethrough, the outer sheet form being connected to the outer edges of the form stiffeners, the inner and outer flexible sheet forms being connected together.

19. The foundation wall assembly as claimed in claim 15, in which each form stiffener further comprises:

(a) a plurality of form connectors which cooperate with the inner and outer edges of the form stiffener and the flexible sheet form element so as to secure at least a portion of the upper portions of the flexible sheet form element to the inner and outer edges respectively.

20. The foundation wall as claimed in claim 19, in which:

(a) the lower end portions of the form stiffeners are spaced above the site surface, (b) the plurality of form connectors include inner and outer form connectors which cooperate with inner and outer edges of the form stiffener respectively, the outer form connector having a lower end portion generally adjacent the lower end portion of the form stiffener, and the inner form connector having a lower end portion spaced above the lower end portion of the form stiffener, and (c) the flexible sheet form element ha s an outer flexible sheet form extending from the lower end portion of the outer form connector generally vertically downwardly to the site surface to pass beneath the form stiffener, and an inner flexible sheet form extending from the lower end portion of the form connector inwardly and laterally away from the inner form stiffener to provide an asymmetrical footing which is displaced inwardly of the foundation wall so as to provide an substantially straight outer wall of the completed foundation wall.

21. The foundation wall as claimed in claim 20, in which:

(a) each form stiffener includes a supporting frame having interconnected inner and outer columns, the columns having outwardly facing outer faces, and (b) each form connector comprises an elongated strip connected to one outer face of one column of each form stiffener, and the foundation form assembly further comprises:

(c) a plurality of complementary fastener portions cooperating with each elongated strip and the respective column so as to sandwich portions of the is flexible sheet form element between the form connectors and the outer faces of the columns.

22. The foundation wall assembly as claimed in claim 21, in which the complementary fastener portions comprise:

(a) each elongated strip of each form connector having a plurality of projections extending therefrom, the projections being received in corresponding openings produced in the flexible sheet form element by the projections, and (b) each outer face of each column of each form stiffener having a plurality of clearance portions to receive the projections of the respective elongated strip therein so as to retain the strip against the respective column.

23. The foundation wall assembly as claimed in claim 15, further comprising:

(a) a reinforcing member located between opposed portions of the lower portions of the flexible sheet form element to reinforce the foundation material when set.

24. The foundation wall assembly as claimed in claim 23, in which:

(a) each form stiffener has a reinforcing member holder provided thereon, and (b) the reinforcing member is retained within the holder to control location of the reinforcing member within the foundation wall.

25. A method of constructing a building foundation wall, comprising the steps of:

(a) temporarily supporting a floor assembly of a building above a site surface, (b) connecting a plurality of form stiffeners at longitudinally spaced apart intervals along the floor assembly so that the form stiffeners extend downwardly from the floor assembly, (c) positioning a foundation form assembly along an axis of the building foundation wall to be constructed, the form assembly comprising a longitudinally extending flexible sheet form element, (d). connecting inner and outer upper portions of the flexible sheet form element to at least upper portions of the outwardly facing edges of the form stiffeners so that said upper portions of the sheet form element Are laterally spaced apart on opposite sides of the axis and hang below the floor assembly, supporting a lower portion of the flexible sheet form element on the site surface to form the element into a generally U-shaped cross section, and locating the sheet element to extend as a substantially continuous elongated container below the floor assembly, and (e) supplying a flowable and settable foundation material to substantially fill spaces within the elongated container and between the upper portions of the flexible sheet form element so that the lower portion of the flexible sheet form element is displaced downwardly by weight of the foundation material to rest upon the site surface so that the foundation material extends substantially continuously upwardly from the site surface to an upper surface of the foundation wall which is substantially in contact with a lower surface of the floor assembly so as to support the floor assembly when the foundation material has set.

26. A method as claimed in claim 25, further characterized by:

(a) restricting the upper portions of the flexible sheet form element from excessive lateral movement from force of the foundation material such that, when the foundation material within the elongated container rests on the site surface, width of the container as measured generally transversely to the foundation wall is greater than lateral spacing between the upper portions of the flexible sheet form element.

27. A method as claimed in claim 25, further characterized by:

(a) providing each form stiffener with laterally spaced apart and interconnected inner and outer columns, and (b) connecting the laterally spaced apart upper portions of the flexible sheet form element to the inner and outer columns.

28. A method as claimed in claim 27, in which the connecting of the form element to the columns further comprises:

(a) providing a plurality of connectors which cooperate with the inner and outer columns of the form stiffeners, and (b) sandwiching the upper portions of the flexible sheet form element between the columns and respective connectors so that the connectors secure the flexible sheet form element to the form stiffeners.

29. A method as claimed in claim 28, in which the connecting of the form element to the columns further comprises:

(a) penetrating the upper portions of the flexible sheet form element with barb-like projections of the connectors, the barb-like projections cooperating with frames of the form stiffeners for retention on the form stiffeners to restrict lateral movement of the flexible sheet form element with respect to the form stiffener.

* * * * *